United States Patent [19]

Mavrakis

[11] Patent Number: 4,782,960

[45] Date of Patent: Nov. 8, 1988

[54] DIVIDER WITH RESILIENT BASE ENGAGEMENT

[75] Inventor: Steve Mavrakis, New York City, N.Y.

[73] Assignee: Supreme Equipment & Systems Corp., Brooklyn, N.Y.

[21] Appl. No.: 50,225

[22] Filed: May 14, 1987

Related U.S. Application Data

[63] Continuation-in-part of Ser. No. 876,742, Jun. 20, 1986, abandoned, which is a continuation-in-part of Ser. No. 501,704, Jun. 6, 1983, abandoned.

[51] Int. Cl.[4] ..... A47F 5/00

[52] U.S. Cl. ..... 211/184; 211/43

[58] Field of Search ..... 211/184, 51, 43, 46; 248/225.1, 221.4, 222.2, 231.2; 312/183, 193; 220/22.5, 22.6, 22.2, 22.4

[56] References Cited

U.S. PATENT DOCUMENTS 935,560 9/1909 Stone ..... 211/184
2,983,475 5/1961 Slavsky ..... 248/221.4
3,297,290 1/1967 Patterson ..... 211/184

FOREIGN PATENT DOCUMENTS 156318 6/1939 Fed. Rep. of Germany ... 248/221.4
2011792 10/1971 Fed. Rep. of Germany ..... 211/184
477842 10/1969 Switzerland ..... 211/184

*Primary Examiner*—Ramon S. Britts
*Assistant Examiner*—Blair M. Johnson
*Attorney, Agent, or Firm*—Lieberman Rudolph & Nowak

[57] ABSTRACT

An adjustable divider for a shelf or a drawer of a file cabinet is formed entirely of a spring wire. One end of the spring wire is configured as an engagement portion which has a longitudinal portion for engaging within an acute angle between a first wall portion and a bottom surface of a notch in a horizontal base which supports files, books, or any other items to be maintained in an upright orientation. A second wall portion of the notch is substantially orthogonal to the bottom surface of the notch and maintains the longitudinal portion in resilient compression against the first wall portion of the notch.

8 Claims, 4 Drawing Sheets

FIG. 2
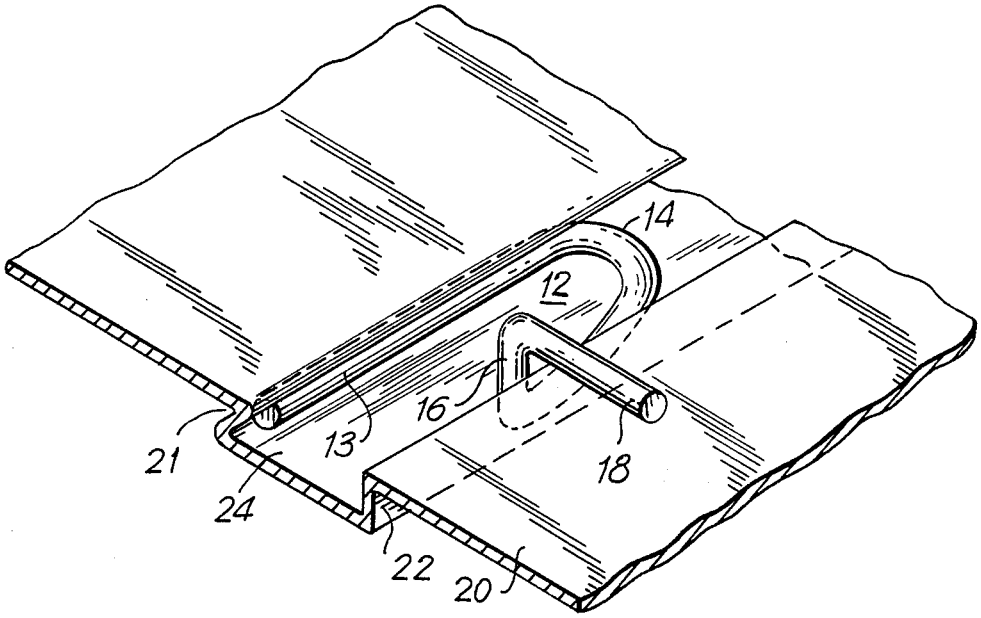
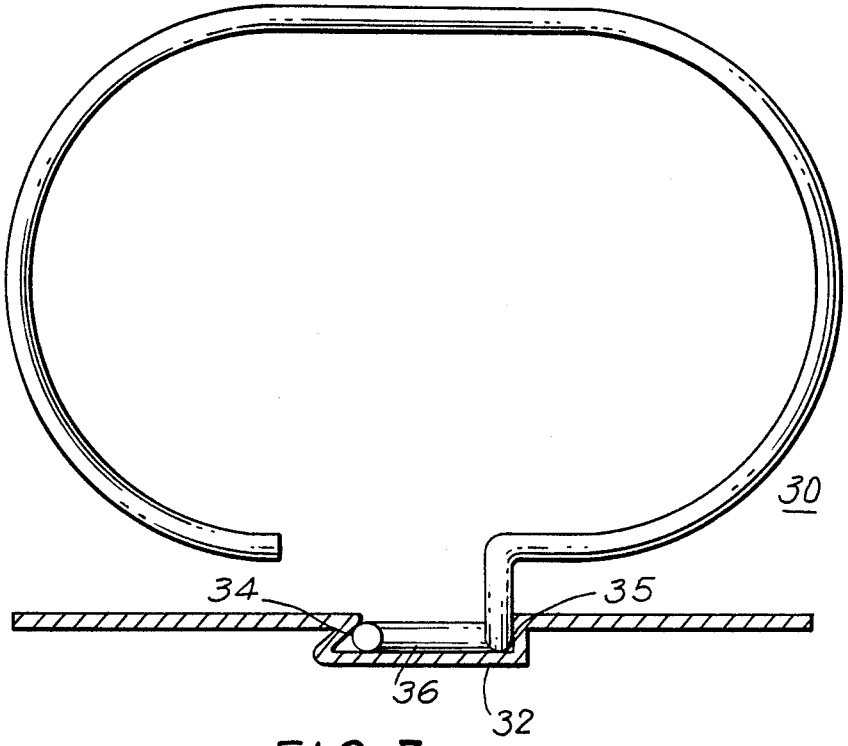
FIG. 3

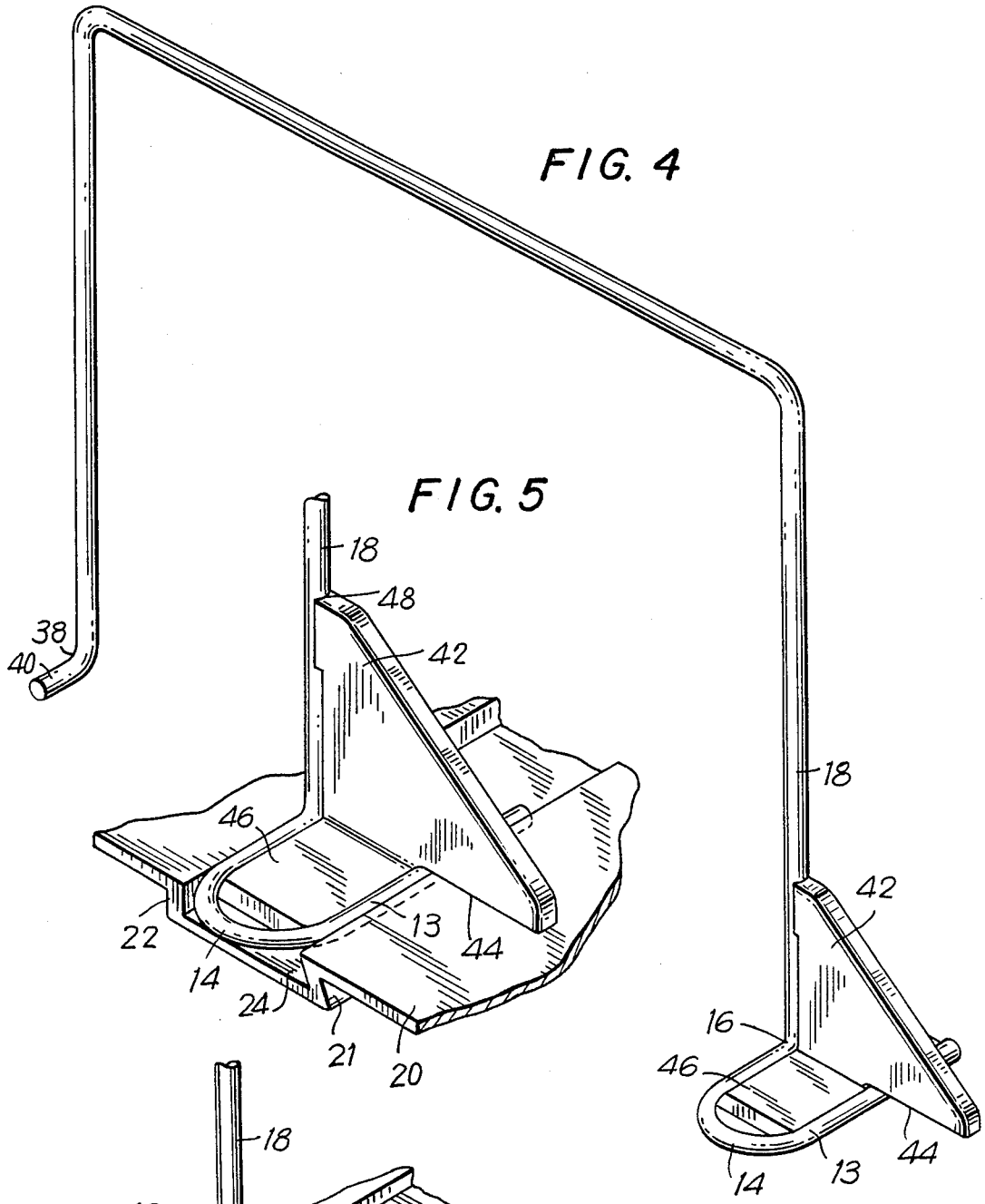
FIG. 4
FIG. 5
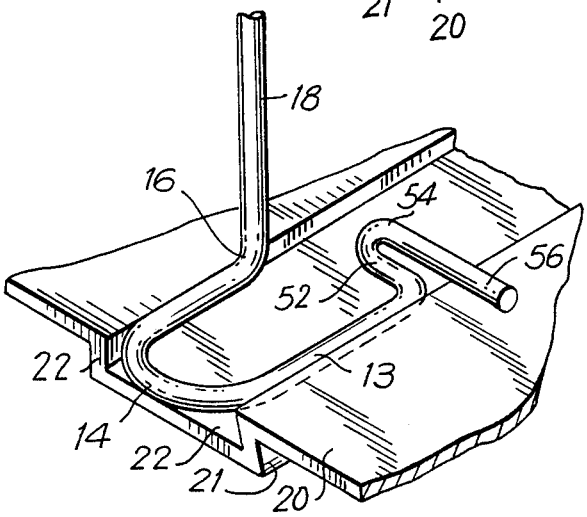
FIG. 7

DIVIDER WITH RESILIENT BASE ENGAGEMENT

PRIOR APPLICATION

This application is a continuation-in-part of Ser. No. 876,742 filed on June 20, 1986 which is in turn a continuation-in-part of Ser. No. 510,704, filed June 6, 1983, both of which are now abandoned.

FIELD OF THE INVENTION

This invention relates generally to divider arrangements for shelves, file cabinets, and the like, and more particularly, to an adjustable file divider arrangement formed of a wire-like material having a resilient portion for engaging with an asymmetrical track notch.

BACKGROUND OF THE INVENTION

There has long existed a need for a simple and economical divider arrangement which can be used to separate various classifications of files, books and other classifiable articles. It is a requirement of such divider systems that they be adjustable so that they may be placed longitudinally anywhere along a shelf or within the drawer of a file cabinet. Such adjustability permits the numbers of files in the various classifications to be varied, while maintaining the remaining files in desired vertical positions. Vertical positioning maximizes the utilization of space in the file cabinet drawer on the shelf, and prevents warping of the documents stored within the files.

Several divider arrangements have been proposed in the prior art, which divider arrangements have functioned well, but have not been simple in their construction and inexpensive to the purchaser. One well known divider system for a file cabinet drawer (U.S. Pat. No. 871,372) is formed of a sheet material, such as a sheet metal, which has been formed in two parts, a divider part and a track engagement part. The track engagement part is provided with a base having a forwardly projecting tongue which has a substantially T-shaped form. Underneath the base is provided a locking portion which is bent to have depending flanges in an inverted U-shaped configuration. The locking portion is secured to the base by a screw, a rivet, or the like. Above the base is provided the divider portion of the arrangement, which physically separates the files. Finally, the locking portion engages with a track which must have sufficient depth to accommodate the flanges of the U-shaped locking portion and a shaft which bears a cam for locking the divider arrangement at a desired location along the track.

In addition to its obvious complexity, this known divider arrangement requires a substantial track depth which consumes a considerable volume within a file cabinet. Moreover, such a divider arrangement is not suitable for shelving because, for long runs of shelving, the cam shaft with its associated trunion bearings is prohibitively expensive. In addition, this arrangement is very inconvenient for use in conjunction with long shelves, and the actuation of the shaft would release all of the dividers on the shelf, even though only one or two dividers thereon may be desired to be affected.

The prior art has endeavored to overcome the complexity and expense of the known divider arrangements by providing a further device (U.S. Pat. No. 879,343) constructed of bent sheet metal which has been formed into a loop with resilient arms and provided with bent flanges which engage beneath the flanges of a track.

The apex of the bend of one of the flanges of the loop is provided with a sheet metal tongue, and the other bend, at its apex, is provided with a matching aperture such that when the flanges of the loop are engaged with the track, the tongue engages with the aperture at the respective bends of the loop to prevent the resilient arms of the loop from moving laterally with respect to each other and out of alignment. Although this known arrangement provides substantial advantages in terms of diminished complexity and cost over the divider arrangement discussed hereinabove, this arrangement nevertheless requires the stamping of a blank for forming the resilient loop, the production of the tongue and the aperture, the notching of a base on which the files rest, and the installation of a track and a notch. Thus, notwithstanding that this arrangement does not require a shaft with a cam, as does the previously discussed arrangement, this arrangement has the disadvantages that it is longitudinally relatively thick and therefore takes up substantial file space on the shelf or in the drawer where it is installed. In addition, the known configuration is deeper at the bottom than at the top thereby being adaptable for restraining files predominantly in one direction only.

Many of the disadvantages of the foregoing prior art arrangements are overcome by a further known divider arrangement (U.S. Pat. No. 1,477,234) which is formed of a spring wire which is curved to form a vertical loop which supports the files in their vertical positio. This further known arrangement is provided with a rod which is arranged parallel to the longitudinal dimension of the drawer or shelf on which it is arranged and is raised above the base of the shelf or drawer by several inches. The rod, therefore, runs longitudinally along side the upright files. The divider is provided with a coiled end which is spiraled around the rod in a direction opposite to the force applied against the loop by the vertical files. Thus, although this arrangement is simple and inexpensive, it is subject to the disadvantages of requiring a rod to be placed along side the stack of files, and of allowing the files to be placed on only one side of the divider. In addition, in embodiments where the files are placed on a shelf, the rod renders difficult removal of the files from one side of the shelf and, in filing systems which utilize long shelves, periodic reinforcements are required for the rod.

Another known shelf divider arrangement involves a plurality of longitudinally spaced slots running the length of the horizontal shelf base. The vertical shelf back also carries spaced slots in alignment with the horizontal slots on the shelf base. A divider comprising a flat piece of sheet metal is provided with engagement members at respective orthogonal edges which fit into corresponding slots on the base member and the vertical back. Clearly, this known arrangement requires careful alignment of the vertical and horizontal slots, thereby greatly increasing the cost of manufacture.

It is, therefore, an object of this invention to provide a simple and inexpensive file divider arrangement.

It is a further object of this invention to provide a divider arrangement which can be formed easily without the need for producing tongues, flanges, or other structurally supported elements.

It is a still further object of this invention to provide a shelf divider arrangement which can support files, books, or other items from either side thereof.

It is still another object of this invention to provide a divider arrangement which does not require substantial longitudinal space on a shelf or in a drawer of a file cabinet.

It is also a further object of this invention to provide a divider arrangement which engages with a simple track or notch in a base.

It is also a further object of this invention to provide a divider arrangement which, when utilized on a horizontal shelf filing system, files can be removed from either side of the shelf without difficulty.

It is yet another object of this invention to provide a divider arrangement wherein the base does not require a separate track arrangement affixed thereto.

It is also another object of this invention to provide a divider system wherein the same divider can be used irrespective of whether the base is formed of either a bent sheet material, such as sheet metal, or a thick material having a longitudinal notch therein.

SUMMARY OF THE INVENTION

The foregoing and other objects are achieved by this invention which provides an adjustable divider arrangement of the type which is provided with a longitudinal base member for supporting files, books, or other items which are desired to be filed, and a divider member for engaging with the base member at any desired location along the longitudinal axis of the base member. The divider arrangement is provided with an asymmetrical notch in the base member which notch is configured to have a reference plane offset from a base plane of the base member by a predetermined offset distance; the reference plane and the base plane being connected by first and second wall portions on either side of the notch. The wall portions are arranged at different angles with respect to the base plane and reference plane.

In one embodiment, the first wall portion is arranged at an acute angle with respect to the base and reference planes, while the second wall portion is substantially orthogonal thereto. The divider is formed of a somewhat resilient wire-shaped material which is bent to have an engagement portion which couples resiliently with the notch. The engagement portion is formed as an open loop having a longitudinal portion which communicates with the first wall portion in the notch. The second wall portion communicates with a further portion of the resilient loop of the engagement portion of the divider so that the longitudinal portion of the loop is urged resiliently against the first wall portion.

In another embodiment, the base member and its notch are formed of a continuous sheet material, such as sheet material, having a predetermined thickness. In such an arrangement, the reference and base member places are offset by a predetermined distance which is greater than a cross-sectional dimension of the wire which forms the divider. In embodiments of the invention where the base member is formed of a thick sheet material such as plastic or wood, the notch may be formed by removing a portion of the material to form the reference plane and the first and second wall portions. Of course, the overall thickness of such a sheet material must be greater than the offset distance between the base and reference planes.

In a preferred embodiment of the invention, the engagement portion of the divider is formed continuously of the wire-shaped material with a divider loop which communicates with the filed items being supported vertically on a horizontal base member. The lateral force which is applied against the divider arrangement by the filed items is not sufficient to displace the longitudinal portion of the engagement portion from the notch because the longitudinal portion is restrained within the acute angle formed by the first wall portion and the reference plane. Thus, even though the divider may be easily removed from the notch by applying a force which tends to lift first the portion of the engagement loop which communicates with the second wall portion, such removal requires a rotative force to be applied about the longitudinal direction, while the items filed generally apply only to a longitudinal force which is orthogonal to the required removal force. By such an arrangement, therefore, the divider portion is removable from the notch by the application of forces thereto which cannot be applied by the filed items.

It is an advantage of this invention that the base member can be constructed easily without requiring an excessively deep and volume consuming notch. It is also an advantage of this invention that the divider can be formed entirely of a wireshaped material which is somewhat resilient. Thus, the present invention provides an extremely economical divider arrangement.

BRIEF DESCRIPTION OF THE DRAWINGS

Comprehension of the invention is facilitated by reading the following detailed description in conjunction with the annexed drawings, in which:

FIG. 2 is an isometric representation of a portion of the embodiment of FIG. 1 engaged with a base member formed of a sheet material;

FIG. 3 is a partially cross-sectional plan view of a further embodiment of the invention having a ring-shaped divider loop and base member formed of a thick sheet material.

FIG. 4 is another isometric representation of a divider formed of a resilient spring wire material and wherein a removable insert engages the wire and base member to prevent the divider from tilting forward.

FIG. 5 is a partial isometric representation of a divider and the removable insert in place on a base member.

FIG. 7 is another isometric representation of a divider formed of a resilient spring wire material which contains means formed by the wire itself for preventing the divider form tilting forward.

DETAILED DESCRIPTION

Figure 1:
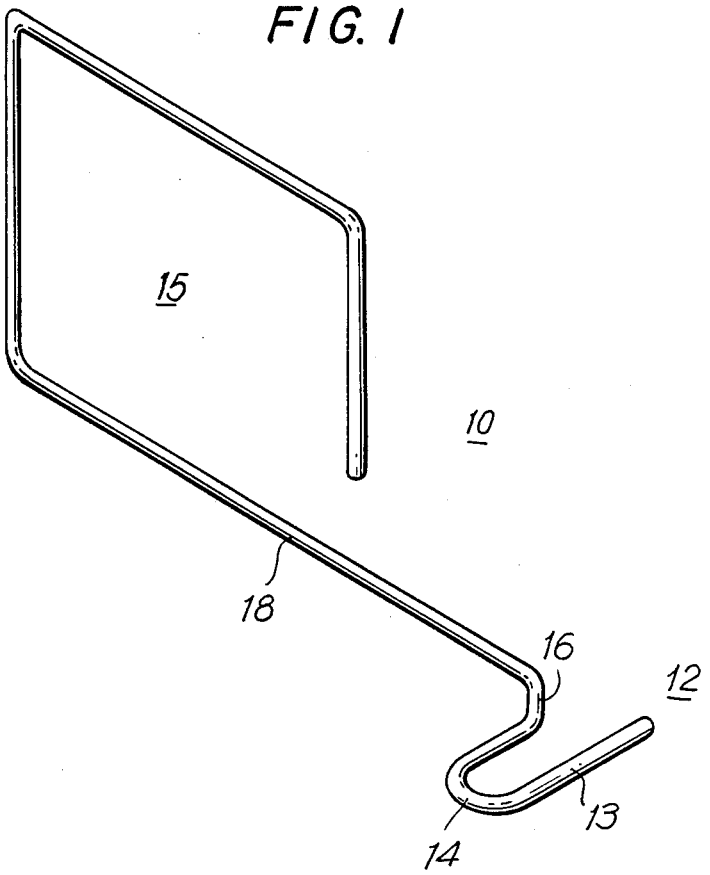
FIG. 1 is an isometric representation of a divider formed of a resilient spring wire material shaped in accordance with the invention.

FIG. 1 is an isometric representation of a divider which is generally designated as 10 and is configured in accordance with the principals of the invention. Divider 10 is formed essentially of an engagement portion 12 and a divider portion 15. Engagement portion 12 is shaped as a partially opened loop and is provided with a longitudinal portion 13. Longitudinal portion 13 is formed continuously with a curved portion 14, which in this embodiment, is continuous with divider portion 15.

FIG. 2 is an isometric representation of engagement portion 12 shown in engagement with a base member 20 formed of a bent sheet material. As shown in this figure, base member 20 is provided with a notch formed of first and second wall portions 21 and 22, respectively, and a bottom portion 24 which, in this embodiment, forms a reference plane which is parallel with the major plane of base member 20.

First and second wall portion 21 and 22 connect bottom portion 24 with the main body of base member 20. As shown, however, the first and second wall portions are not arranged at equal or symmetrical angles with respect to bottom portion 24. First wall portion 21 forms an acute angle with respect to the bottom portion, while second wall portion 22, in this embodiment, is shown to be orthogonal with respect to the bottom portion and the major plane of the base member. The acute angle formed by wall portion 21 can range between 30° and 60°. However, in a preferred embodiment, the acute angle is made to be 45°. Thus, the notch, which may also be viewed as a track is not symmetrical.

Engagement portion 12 of divider 10 is shown such that its longitudinal portion 13 is disposed within the acute angle formed by first wall portion 21 and bottom portion 24 of base member 20. In this embodiment, longitudinal portion 13 and curved portion 14 of engagement portion 12 lie in the same plane and are in communication with bottom portion 24. The other end of curved portion 14 is provided with a vertical portion 16 which extends upwardly out of the notch in the base member. In this embodiment, vertical portion 16 continues horizontally with a lower arm 18 which runs essentially parallel with the major plane of base member 20. In the particular illustrative embodiment described herein, lower arm 18 of divider 10 extends to the side such that divider portion 15 is not directly over the notch in the base member. Thus, this embodiment is suitable for applications where the notch is not centered in the file, cabinet drawer or shelf. However, it is contemplated within the scope of this invention that divider portion 15 may be arranged so as to substantially be centered over the notch in the base member.

FIG. 3 is another embodiment of the invention having a divider 30 engaged in a notch in a relatively thick base member 32. As described hereinabove, with respect to FIG. 2, base member 32 is provided with a notch formed of first and second wall portions 34 and 35 and a notched bottom portion 36. In this particular illustrative embodiment of the invention, divider 30 is shown to have a somewhat rounded loop which is arranged to be essentially centered over the notch in the base member. The engagement portion of 30 is similar to that described hereinabove with respect to FIGS. 1 and 2.

FIG. 4 is another isometric representation of a divider 10 shown with removable insert 42, which prevents the divider from tilting forward when rotative force is applied. Optionally, divider 10 can contain portion 38 and 40 as a rest or engaging means to further anchor the divider. Portion 40 can be used to further support divider 10 by inserting it into a retaining trough 41 running parallel to the notch in base member 20, as shown in FIG. 6.

FIG. 5 is a partial isometric representation of divider 10 with arm 18 and showing engagement with base member 20 and removable insert 42. Insert 42 has a horizontal portion 46 affixed to a vertical portion. After divider 10 engages base member 20 and rests on bottom portion 24, removable insert 42 is placed on bottom portion 24 and slid from open portion of divider towards bend 14 engageing the parallel sides 13 and 16 of divider 18. The two outer edges of base portion 46 of insert 42 are concave and engage the divider along side 13 and the opposite side beginning at bend 16. The vertical portion of insert 42 also has a concave edge 48 which engages divider arm 18 and a horizontal edge 44 which rests on base member 20. Removable insert member 42 can be fabricated from plastic, wood, or metal as a single unit or the horizontal and vertical portion made separately and then attached together.

Figure 6:
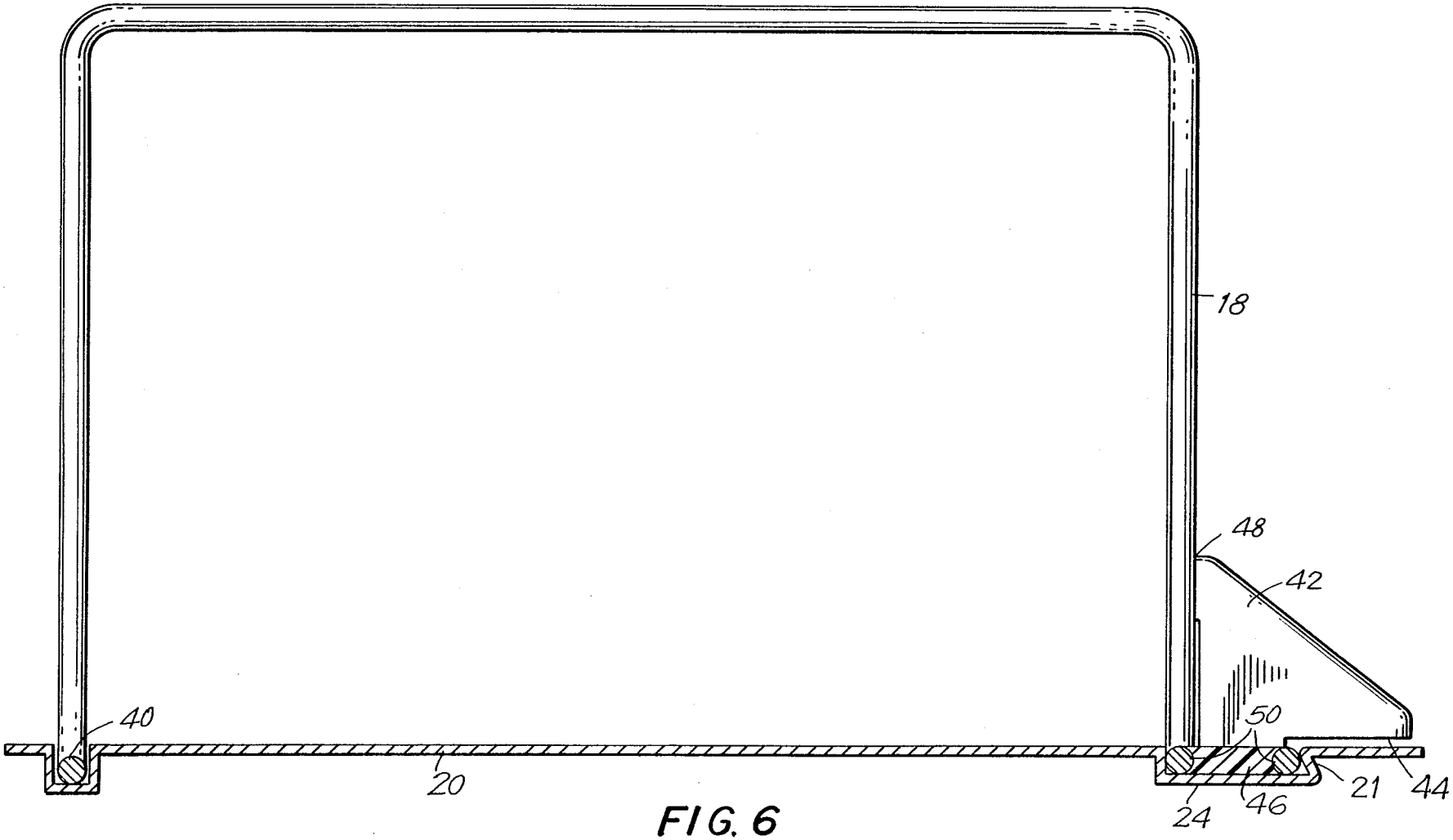
FIG. 6 is a side view of the divider showing the removable insert in partial cross-sectional form.

FIG. 6 is a side view of the divider and shows in cross section base portion 46 of insert 42 and concave edges engaging wires 50. Trough 41 in base member 20 runs parallel to the notch and portion 40 slideably rests within it, further supporting divider 10 and preventing rotation thereof.

FIG. 7 is another isometric representation of a divider which contains means formed by a portion of the divider wire itself to prevent the divider from tilting forward. As shown, divider 18 is an engagement with base member 20 by means of bent portion 10, 14 and 13, which rest in bottom portion 24. Since pressure applied to arm 18 in the direction towards first wall portion 21 might cause disengagement of divider by allowing portion of wire along second wall portion 22 to use vertically, divider 10 is further bent at locations 52 and 54 so that portion 56 rests on the horizontal surface of base member 20.

In using the invention, a divider is engaged with a notch by inserting the longitudinal portion of the engagement portion into the acute angle formed between the first wall portion and the bottom portion of the notch. The remainder of the engagement portion, at the vertically extending portion, is then urged into the notch. Such urging causes a slight radial compression at the curved portion so that logitudinal portion 13 is resiliently urged into the acute angle. It should be noted that the angle formed between the second wall portion and the bottom portion of the notch need not be a right angle, but may be slightly acute so as to provide a firm engagement at both wall portions. In such an embodiment, it is desirable to configure vertical portion 16 so that it is directed slightly inwardly toward the longitudinal portion at an angle which corresponds roughly to the angle between the second wall portion and the bottom portion of the notch. Thus, the divider can be removed easily from the notch and replaced anywhere longitudinally along the shelf depending upon the number of items which are desired to be maintained upright.

Alternatively, the divider can be used with removal insert 42 or be of the configuration shown in FIG. 7 in those cases where bulky and heavy books or files resting on base member 20 might tend to dislodge the divider from bottom portion 24 when they are removed from a shelf.

Although the invention has been described in terms of specific embodiments and applications, persons skilled in the art, in light of this teaching, can generate additional embodiments without departure from the spirit or exceeding the scope of the claimed invention. Accordingly, it is to be understood that the drawings and descriptions in this disclosure are proffered to facilitate comprehension of the invention and should not be construed to limit the scope thereof.

What is claimed is:

1. An adjustable divider arrangement for use in a shelf or file cabinet, of the type provided with a horizontal base member having a longitudinal axis, and a divider member for engaging with the base member at a selective location along the longitudinal axis of said base member, said adjustable divider arrangement futher comprising:

(a) a notch means formed in said base member parallel with its longitudinal axis, said notch means having a reference plane portion offset from, and below, a base plane of said base member by a predetermined offset distance, said notch and base member formed of a continuous piece of the same material;

(b) first and second wall portions for coupling said reference plane portion to said base plane of said member, said first wall portion forming an acute angle with respect to said reference plane of said notch and said second wall portion orthogonal with respect to said reference plane of said notch;

(c) a first distance between said first and second wall portions at said reference plane being greater than a second distance between said first and second wall protions at said base plane of said base member;

(d) a trough formed in said base member parallel to said notch means;

(e) said divider member formed of a continuous wire like material, a first end of which is bent to form a generally "U" shaped engagement means having first and second longitudinal portions arranged substantially parallel with each other for communicating with respective ones of said first and second wall portions, and a resilient portion for connecting said first and second longitudinal portions to one another and;

(f) a divider portion of said divider member extending outwardly from said notch and formed so that a second end of said divider member engages said trough to preventing rotation of said divider about said notch means.

2. The adjustable divider arrangement of claim 1 wherein the wire like material is spring wire.

3. The adjustable divider arrangement of claim 1 wherein base member and said notch means are formed of a continuous sheet material having a predetermined thickness.

4. The adjustable divider arrangement of claim 1, wherein said predetermined thickness of said sheet material is less than said predetermined offset distance and said sheet material is bent to form said notch means.

5. The adjustable divider arrangement of claim 1 wherein said predetermined thickness of said sheet material is greater than said predetermined offset distance, a portion of said sheet material being removed therefrom to form said reference plane portion and said first and second wall portions of said notch means.

6. The adjustable divider arrangement of claim 1 wherein said wire-shaped material has a substantially circular cross-sectional configuration having a predetermined radius, said predetermined offset distance being greater than said predetermined radius.

7. The adjustable divider arrangement of claim 1 wherein said wire-shaped material has a predetermined cross-sectional configuration and a thickness dimension which is smaller than said predetermined offset distance.

8. The adjustable divider arrangement of claim 1 wherein engaging means can be removably inserted between said first and second longitudinal portions of said engagement means.

* * * * *